US007471266B2

(12) United States Patent
Jung et al.

(10) Patent No.: US 7,471,266 B2
(45) Date of Patent: Dec. 30, 2008

(54) METHOD AND APPARATUS FOR DRIVING PLASMA DISPLAY PANEL

(75) Inventors: Yun Kwon Jung, Kumi-shi (KR); Jin Young Kim, Daegu-kwangyeokshi (KR)

(73) Assignee: LG Electronics Inc., Seoul (KR)

( * ) Notice: Subject to any disclaimer, the term of this patent is extended or adjusted under 35 U.S.C. 154(b) by 677 days.

(21) Appl. No.: 10/834,863

(22) Filed: Apr. 30, 2004

(65) Prior Publication Data

US 2005/0012688 A1 Jan. 20, 2005

(30) Foreign Application Priority Data

May 1, 2003 (KR) ..... 10-2003-0028029

(51) Int. Cl.
*G09G 3/28* (2006.01)
*H01J 17/49* (2006.01)

(52) U.S. Cl. ..... 345/68; 345/55; 345/60; 345/63; 315/111.91; 315/169.1; 315/169.4; 313/484; 313/491; 313/585; 313/604; 313/622

(58) Field of Classification Search ..... 345/55, 345/60, 63, 68, 204, 690, 691, 694; 315/111.91, 315/169.1, 169.4; 313/231.31, 484, 491, 313/585, 604, 622
See application file for complete search history.

(56) References Cited

U.S. PATENT DOCUMENTS

| | | | | |
|---|---|---|---|---|
| 6,034,482 | A * | 3/2000 | Kanazawa et al. | 315/169.4 |
| 6,696,794 | B2 * | 2/2004 | Ishizuka | 315/169.1 |
| 6,836,262 | B2 * | 12/2004 | Hashimoto et al. | 345/60 |
| 6,903,514 | B2 * | 6/2005 | Yun et al. | 315/169.4 |
| 7,151,510 | B2 * | 12/2006 | Whang et al. | 345/66 |
| 7,164,395 | B2 * | 1/2007 | Myoung et al. | 345/60 |
| 2002/0130823 | A1 * | 9/2002 | Takayama | 345/60 |

* cited by examiner

*Primary Examiner*—My-Chau T Tran
(74) *Attorney, Agent, or Firm*—KED & Associates, LLP

(57) ABSTRACT

There is disclosed a method and apparatus of driving a plasma display panel that is adaptive for reducing discharge delay upon reset discharge.

A driving method and apparatus of a plasma display panel according to an embodiment of the present invention applies a plurality of pulses to the plasma display panel for the reset period in order to reduce a discharge delay.

61 Claims, 9 Drawing Sheets

METHOD AND APPARATUS FOR DRIVING PLASMA DISPLAY PANEL

This application claims the benefit of Korean Patent Application No. P2003-28029 filed on May 1, 2003, which is hereby incorporated by reference.

BACKGROUND OF THE INVENTION

1. Field of the Invention

The present invention relates to a plasma display panel, and more particularly to a method and apparatus of driving a plasma display panel that is adaptive for reducing discharge delay upon reset discharge.

2. Description of the Related Art

A plasma display panel (hereinafter 'PDP') excites a phosphorus by using ultraviolet ray to emit light, thereby displaying a picture, wherein the ultraviolet ray is generated when inert mixture gas such as He+Xe, Ne+Xe and He+Xe+Ne is discharged. The PDP has its picture quality improved in debt to recent technology development as well as being easy to be made thin in thickness and big in size.

Referring to FIG. 1, a discharge cell of a three electrode AC surface discharge PDP of prior art includes scan electrodes Y1 to Yn, a sustain electrode Z, and address electrodes X1 to Xm crossing the scan electrodes Y1 to Yn and the sustain electrode Z perpendicularly.

A cell 1 is formed at each of the intersections of the scan electrodes Y1 to Y, the sustain electrode Z and the address electrodes X1 to Xm. The scan electrode Y1 to Yn and the sustain electrode Z are formed on an upper substrate (not shown). A dielectric layer and an MgO passivation layer are deposited on the upper substrate. The address electrodes X1 to Xm are formed on a lower substrate (not shown). Barrier ribs are formed on the lower substrate to prevent optical and electrical crosstalk from occurring between the cells that are horizontally adjacent to one another. A phosphorus layer is formed on the surface of the lower substrate and the barrier ribs, wherein the phosphorus is excited by vacuum ultraviolet to emit visible light. Inert mixture gas such as He+Xe, Ne+Xe and He+Xe+Ne is injected into a discharge space provided between the upper/lower substrates.

In order to realize the gray level of a picture, the PDP is time-dividedly driven by dividing one frame into several sub-fields that have the number of their light emission different from one another. Each sub field can be divided into a reset period. to initialize a full screen, an address period to select scan lines and select cells from the selected scan lines, and a sustain period to realize gray levels in accordance with the number of discharge. For example, in the event of displaying a picture with 256 gray levels, the frame period (16.67 ms) corresponding to 1/60 second as in FIG. 2 is divided into 8 sub-fields (SF1 to SF8). Each of the 8 sub-fields (SF1 to SF8), as described above, is divided into the reset period, the address period and the sustain period. The reset period and the address period of each sub-field are the same for each sub-field, while the sustain period and the number of sustain pulses allotted thereto increase at the rate of $2^n$ (n=0,1,2,3,4, 5,6,7) in each sub-field.

FIG. 3 illustrates a driving waveform of a PDP which is applied to two sub-fields.

Referring to FIG. 3, the PDP is driven in the manner of dividing one frame into a reset period to initialize a full screen, an address period to select cells and a sustain period to sustain the discharge of the selected cells.

In the beginning of the reset period, a rising ramp waveform Ramp-up is applied to all scan electrodes Y, and 0V is applied to the sustain electrode Z and the address electrode X. The rising ramp waveform Ramp-up causes a write dark discharge or a setup discharge to occur between the scan electrode Y and the address electrode X and the scan electrode Y and the sustain electrode Z within the cells of the full screen, wherein almost no light is generated in the write dark discharge. The setup discharge causes positive wall charges to be accumulated in the address electrode X and the sustain electrode Z, and negative wall charges to be accumulated in the scan electrode Y.

In the end of the reset period, a falling ramp waveform Ramp-down is simultaneously applied to the scan electrodes Y, wherein the falling ramp waveform Ramp-down declines from around sustain voltage Vs. At the same time, sustain voltage Vs of positive polarity is applied to the sustain electrode Z, and 0V is applied to the address electrode X. When the falling ramp waveform Ramp-down is applied in this way, a erasure dark discharge or a set-down discharge is generated between the scan electrode Y and the sustain electrode Z, wherein almost no light is generated in the erasure dark discharge. The set-down discharge eliminates the excessive wall charges that are unnecessary for the address discharge.

In the address period, negative scan pulses SCAN are sequentially applied to the scan electrodes Y and at the same time positive data pulses DATA synchronized with the scan pulses SCAN are applied to the address electrodes X. When the voltage difference between the scan pulse SCAN and the data pulse DATA is added to the wall voltages generated in the reset period, the address discharge is generated within the cell to which the data pulse DATA is applied. When sustain voltages are applied, wall charges to the extent that the discharge might be generated are formed within the cells selected by the address discharge.

Positive DC voltage Zdc is applied to the sustain electrode Z for the set-down period and the address period so as not to generated a mis-discharge between the scan electrode Y and the sustain electrode Z.

In the sustain period, sustain pulses SUS are alternately applied to the scan electrodes Y and the sustain electrodes Z. In the cells selected by the address discharge, a sustain discharge, i.e., display discharge, is generated between the scan electrode Y and the sustain electrode Z whenever each sustain pulse SUS is applied as the wall voltage within the cell is added to the sustain pulse SUS.

Recently, the content of Xe tends to be increased in order to enhance discharge efficiency in the sealed discharge gas of the PDP. But, there is a problem that jitter value is heightened if the content of Xe is increased, wherein the jitter value represents the extent that discharge is delayed. If the discharge is delayed in this way, the discharge is generated in a big scale beyond the extent of a desired discharge level, so that it becomes difficult to control wall charges and the black brightness of the reset period heightens, thereby deteriorating its contrast characteristic. It will be explained in detail in conjunction with FIGS. 4 and 5.

In the PDP where the content of Xe is low, an applied voltage Vyz and a gap voltage Vg are supplied for the reset period, as shown in FIG. 4. The applied voltage is a voltage between the scan electrode Y and the sustain electrode Z, which is applied to the scan electrode Y and the sustain electrode Z from an external driving circuit, as shown in FIG. 3. The gap voltage Vg is a voltage applied to the discharge gas and the gap voltage Vg causes discharge to be generated within the cell.

If the content of Xe is low, the setup discharge of the reset period is generated when the gap voltage Vg reaches a firing voltage Vf. After the setup discharge is generated, the gap voltage Vg remains at the firing voltage Vf until the ramp waveform Ramp-dn of descending tilt is applied to the scan electrode Y. In the same manner, the set-down discharge of the reset period is generated when the gap voltage Vg reaches a firing voltage −Vf. After the set-down discharge is generated, the gap voltage Vg remains at the firing voltage −Vf until a scan bias voltage is applied to the scan electrode Y. On the other hand, in an initial state 41 before the reset period starts, the wall voltage Vg might be different by cells because the number of sustain discharges and so on are different by cells.

If the content of Xe is high, as shown in FIG. 5, the setup discharge is not generated at the point of time tf when the gap voltage Vg reaches the firing voltage Vf but is generated at the point of time tf' that is delayed by a jitter value from the point of time tf because of the discharge delay caused by the high content of Xe. At the point of time tf', the wall voltage Vf increases to a voltage higher than the firing voltage Vf as the external applied voltage Vyz increases. Accordingly, the setup discharge is generated in a big scale beyond the extent of a desired discharge level. Likewise, if the content of Xe is high, the set-down discharge is generated in a big scale.

SUMMARY OF THE INVENTION

Accordingly, it is an object of the present invention to provide a method and apparatus of driving a plasma display panel that is adaptive for reducing discharge delay upon reset discharge.

In order to achieve these and other objects of the invention, a driving method of a plasma display panel having an address electrode, a scan electrode and a sustain electrode wherein one frame is divided into a reset period, an address period and a sustain period, according to an aspect of the present invention includes the step of: applying a plurality of pulses to the plasma display panel for the reset period to reduce a discharge delay.

In the driving method, the pulses are applied to at least one of the address electrode, the scan electrode and the sustain electrode.

In the driving method, the pulses are of positive voltage.

In the driving method, the pulses are of negative voltage.

The driving method further includes the steps of: initializing a cell by consecutively applying a rising ramp waveform and a falling ramp waveform to the scan electrode for the reset period to cause a write setup discharge and an erasure set-down discharge to be generated; selecting the call by simultaneously applying a scan pulse to the scan electrode and data to the data electrode for the address period; and performing display on the cell by alternately applying a sustain pulse to the scan electrode and the sustain electrode for the sustain period.

The driving method further includes the step of: eliminating wall charges within the cell by applying an erasure signal to at least one of the scan electrode and the sustain electrode between the sustain period and the reset period.

A driving method of a plasma display panel having an address electrode, a scan electrode and a sustain electrode with a cell disposed at each intersection of the electrodes wherein one frame is divided into a reset period, an address period and a sustain period according to another aspect of the present invention includes, includes the step of: applying impact to the discharge gas of the cell by supplying a plurality of pulses to at least one of the address electrode, the scan electrode and the sustain electrode for the reset period; and initializing the cell by applying a gradually-increasing voltage to at least one of the scan electrode and the sustain electrode to generate a discharge within the cell after impact is applied to the discharge gas.

In the driving method, the pulses applies impact to the discharge gas to apply a gap voltage lower than a firing voltage to the cell.

In the driving method, the pulses are pulse signals of high frequency band.

In the driving method, the pulses are of positive voltage.

In the driving method, the pulses are of negative voltage.

In the driving method, the step of initializing the cell by applying a gradually-increasing voltage to at least one of the scan electrode and the sustain electrode to generate a discharge within the cell further includes the step of: initializing the cell by consecutively applying a rising ramp waveform and a falling ramp waveform to the scan electrode for the reset period to generate a write setup discharge and an erasure set-down discharge.

The driving method further includes the steps of: selecting the cell by simultaneously applying a scan pulse to the scan electrode and data to the data electrode for the address period; and performing display on the cell by alternately applying a sustain pulse to the scan electrode and the sustain electrode for the sustain period.

The driving method further includes the step of: eliminating wall charges within the cell by applying an erasure signal to at least one of the scan electrode and the sustain electrode between the sustain period and the reset period.

A driving apparatus of a plasma display panel having an address electrode, a scan electrode and a sustain electrode wherein one frame is divided into a reset period, an address period and a sustain period according to still another aspect of the present invention includes a initialization driver to apply a plurality of pulses to the plasma display panel for the reset period in order to reduce a discharge delay.

The initialization driver applies the pulses to at least one of the address electrode, the scan electrode and the sustain electrode.

The initialization driver generates the pulses of positive voltage.

The initialization driver generates the pulses of negative voltage.

A driving apparatus of a plasma display panel having an address electrode, a scan electrode and a sustain electrode with a cell disposed at each intersection of the electrodes wherein one frame is divided into a reset period, an address period and a sustain period according to still another aspect of the present invention includes a first initialization driver to apply a plurality of pulses to at least one of the address electrode, the scan electrode and the sustain electrode for the reset period in order to apply impact to the discharge gas of the cell; and a second initialization driver to apply a gradually-increasing voltage to at least one of the scan electrode and the sustain electrode to generate a discharge within the cell after impact is applied to the discharge gas.

The pulses applies impact to the discharge gas to apply a gap voltage lower than a firing voltage to the cell.

BRIEF DESCRIPTION OF THE DRAWINGS

These and other objects of the invention will be apparent from the following detailed description of the embodiments of the present invention with reference to the accompanying drawings, in which.

DETAILED DESCRIPTION OF THE PREFERRED EMBODIMENT

Reference will now be made in detail to the preferred embodiments of the present invention, examples of which are illustrated in the accompanying drawings.

With reference to FIGS. 6 to 9, embodiments of the present invention will be explained as follows.

Figure 6:
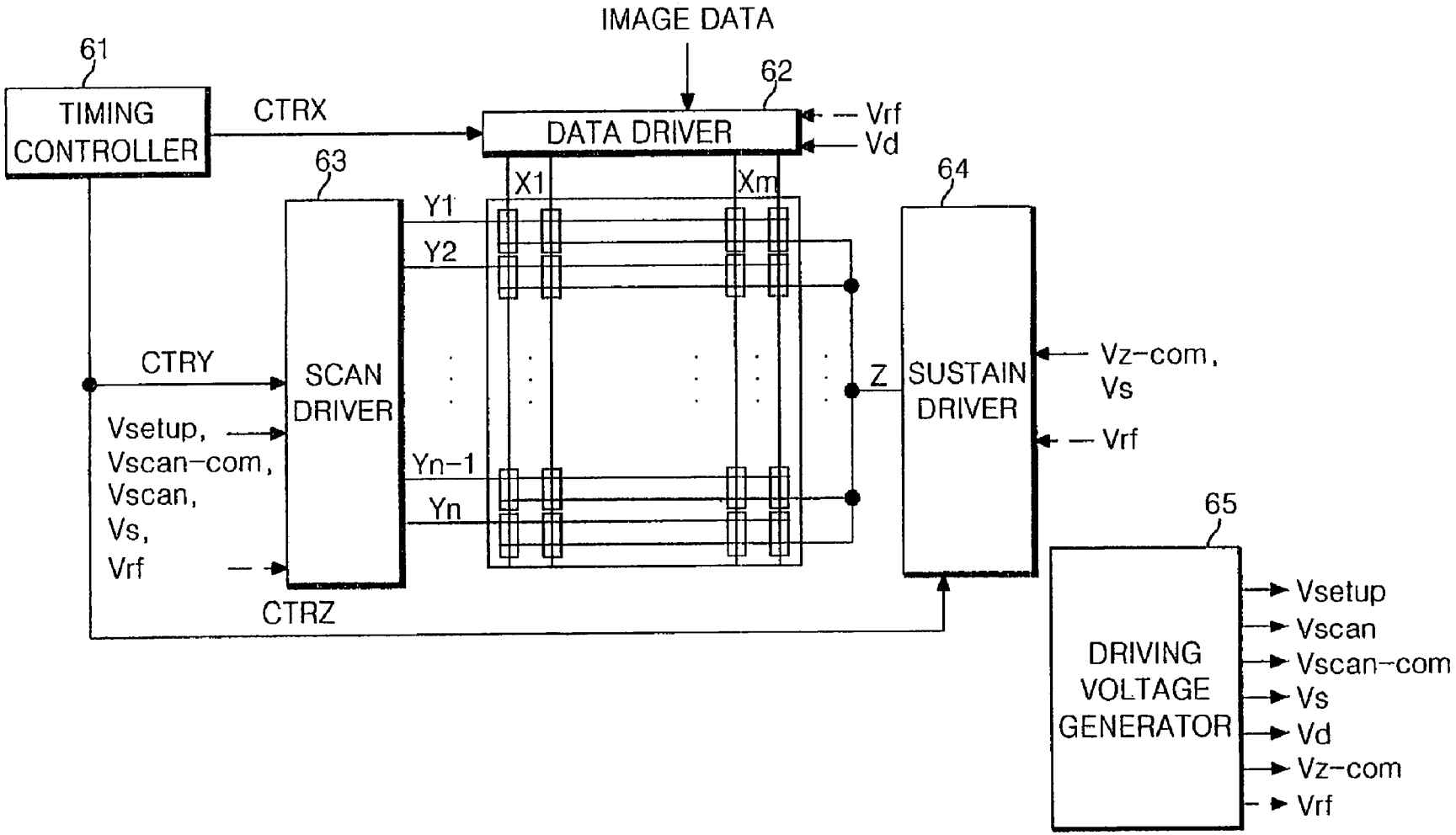
FIG. 6 is a block diagram representing a driving apparatus of a plasma display panel according to an embodiment of the present invention.

Referring to FIG. 6, a driving apparatus of a PDP according to an embodiment of the present invention includes a data driver 62 to supply data to address electrodes X1 to Xm, a scan driver 63 to drive scan electrodes Y1 to Yn, a sustain driver 64 to drive a sustain electrode Z as a common electrode, a timing controller 61 to control each of the drivers 62, 63, 64, and a driving voltage generator 65 to supply a driving voltage to each of the drivers 62, 63, 64.

The data driver 62 receives data that are mapped to the subfield patterns which are preset by a subfield mapping circuit after the data is reverse-gamma-corrected and error-diffused by a reverse gamma correction circuit and an error diffusion circuit (not shown). The data driver 62 samples and latches the data under control of the timing controller 61, and then supplies the data to the address electrodes X1 to Xm.

The scan driver 63 consecutively supplies a rising ramp waveform and a falling ramp waveform that are to initialize the full screen, to the scan electrodes Y1 to Yn for the reset period under control of the timing controller, and then sequentially supplies the negative scan pulse to the scan electrodes Y1 to Yn for the address period. Also, the scan driver 63 supplies to the scan electrodes Y1 to Yn the sustain pulse that causes sustain discharge to be generated in the selected cells for the sustain period. And the scan driver 63 might supply to the scan electrodes Y1 to Yn an erasure signal that is for eliminating remaining wall charges within the cell after the sustain discharge is finished.

The sustain driver 64 supplies a positive DC bias voltage for at least part of the reset period under control of the timing controller 61 to increase an address driving margin. Also, the sustain driver 64, which is alternately operated with the scan driver 63, supplies the sustain pulse to the sustain electrode Z for the sustain period after supplying the positive DC bias voltage to the sustain electrode Z for the address period.

The timing controller 61 receives vertical/horizontal synchronization signals, generates timing control signals CTRX, CTRY, CTRZ that are necessary for the drivers 62, 63, 64, and supplies the timing control signals CTRX, CTRY, CTRZ to the corresponding drivers 62, 63, 64, thereby controlling the drivers 62, 63, 64, respectively. The timing control signal CTRX supplied to the data driver 62 includes a sampling clock to sample data, a latch control signal, a switch control signal to control the on/off time of an energy recovery circuit and a driving switch device. The timing control signal CTRY applied to the scan driver 63 includes a switch control signal to control the on/off time of an energy recovery circuit and a driving switch device within the scan driver 63. The timing control signal CTRZ applied to the sustain driver 64 includes a switch control signal to control the on/off time of an energy recovery circuit and a driving switch device within the sustain driver 64.

The driving voltage generator 65 generates a setup voltage Vsetup to be set as a voltage of rising ramp waveform, a scan bias voltage Vscan-com supplied to the scan electrode Y for the address period, a scan voltage Vscan to be set as a voltage of falling ramp waveform and scan pulse, and a sustain voltage Vs of sustain pulse and a data voltage Vd.

Any one of the data driver 62, the scan driver 63 and the sustain driver 64 supplies a pulse of high frequency band where a plurality of pulses are generated for a short time, to the address electrode for at least part of the reset period. The high frequency pulse waveform applies impact to the discharge gas within the cell for the reset period to make discharge gas particles actively move, thereby causing the delay of the setup discharge or the set-down discharge to be delayed. In other words, the high frequency pulse waveform applies the gap voltage at a voltage close to the firing voltage, to the discharge gas with the cell before the discharge is generated within the cell. The voltage of high frequency pulse waveform might be set to be a voltage generated at the existing driving circuit, such as a data voltage Vd, a sustain voltage Vs, and be supplied as a separate voltage Vrf to each of the driving electrodes X1 to Xm, Y1 to Yn, Z.

Figure 7:
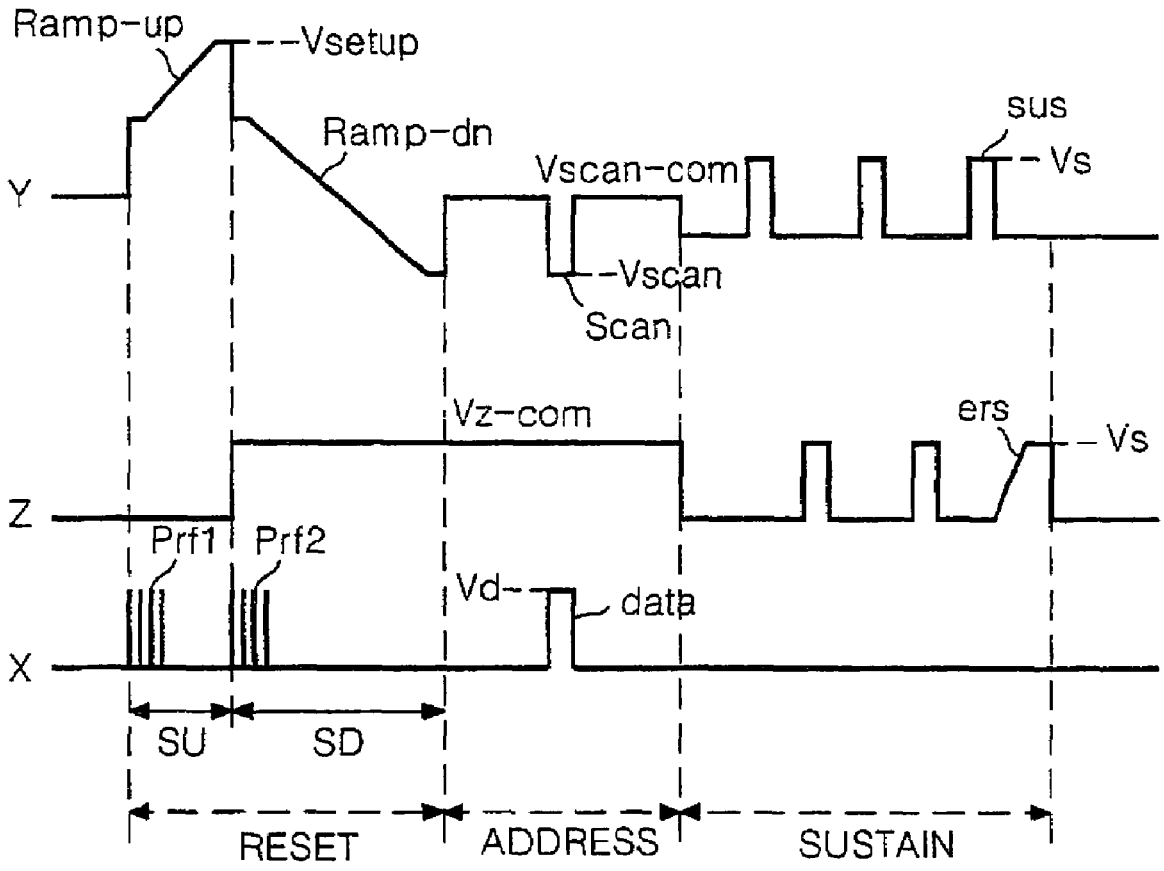
FIG. 7 is a waveform diagram to explain a driving method of a plasma display panel according to a first embodiment of the present invention.

FIG. 7 represents the driving waveform of a PDP according to a first embodiment of the present invention.

Referring to FIG. 7, a driving method of a PDP according to a first embodiment of the present invention time-dividedly drives the PDP by dividing one frame period into a reset period to initialize the cells of the PDP, an address period to select the cells, and a sustain period to sustain the discharge of the selected cells.

Figure 1:
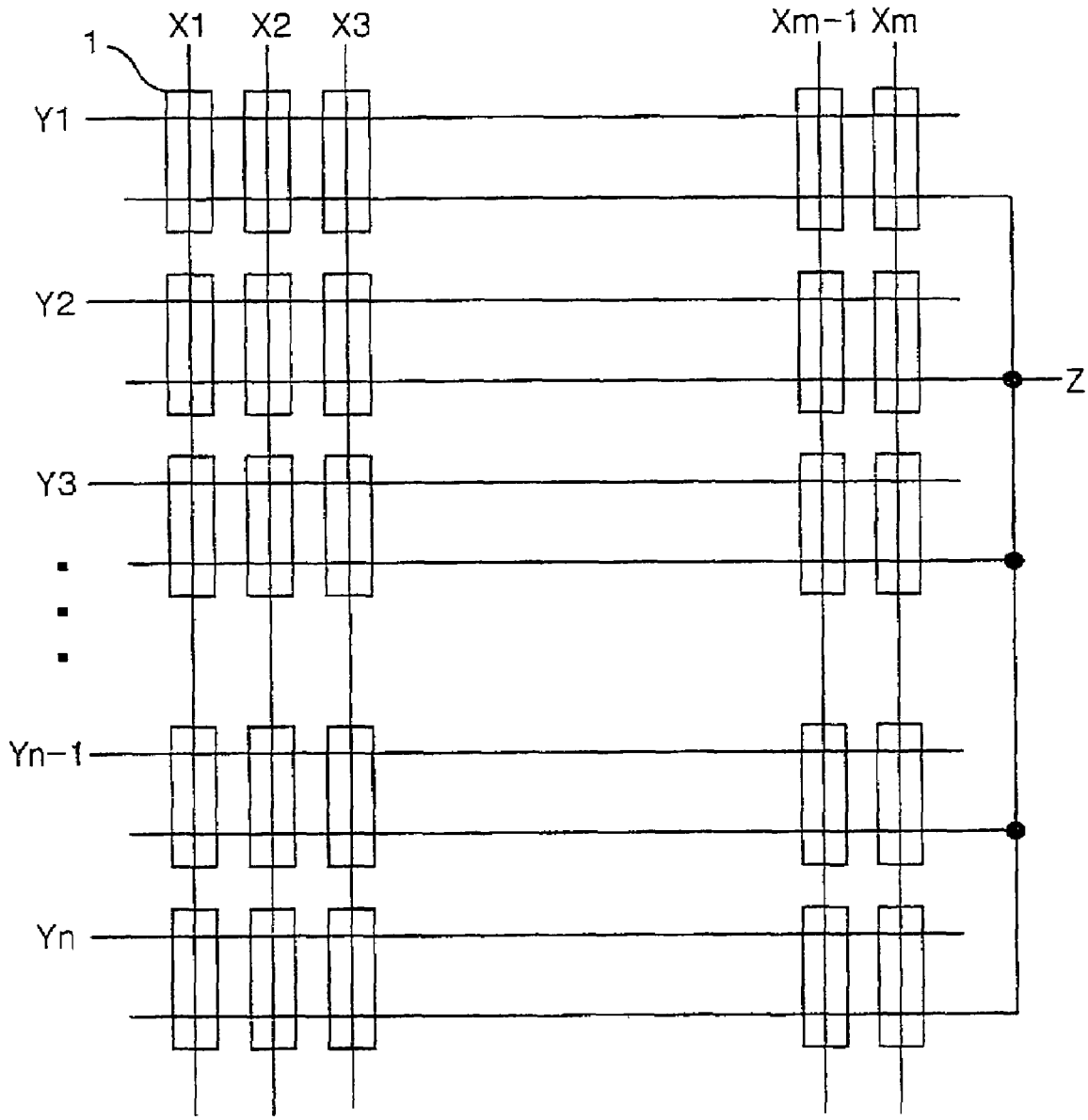
FIG. 1 RELATED ART
FIG. 1 is a plan view representing the electrode arrangement of a 3-electrode AC surface discharge plasma display panel of prior art in brief.
Figure 2:
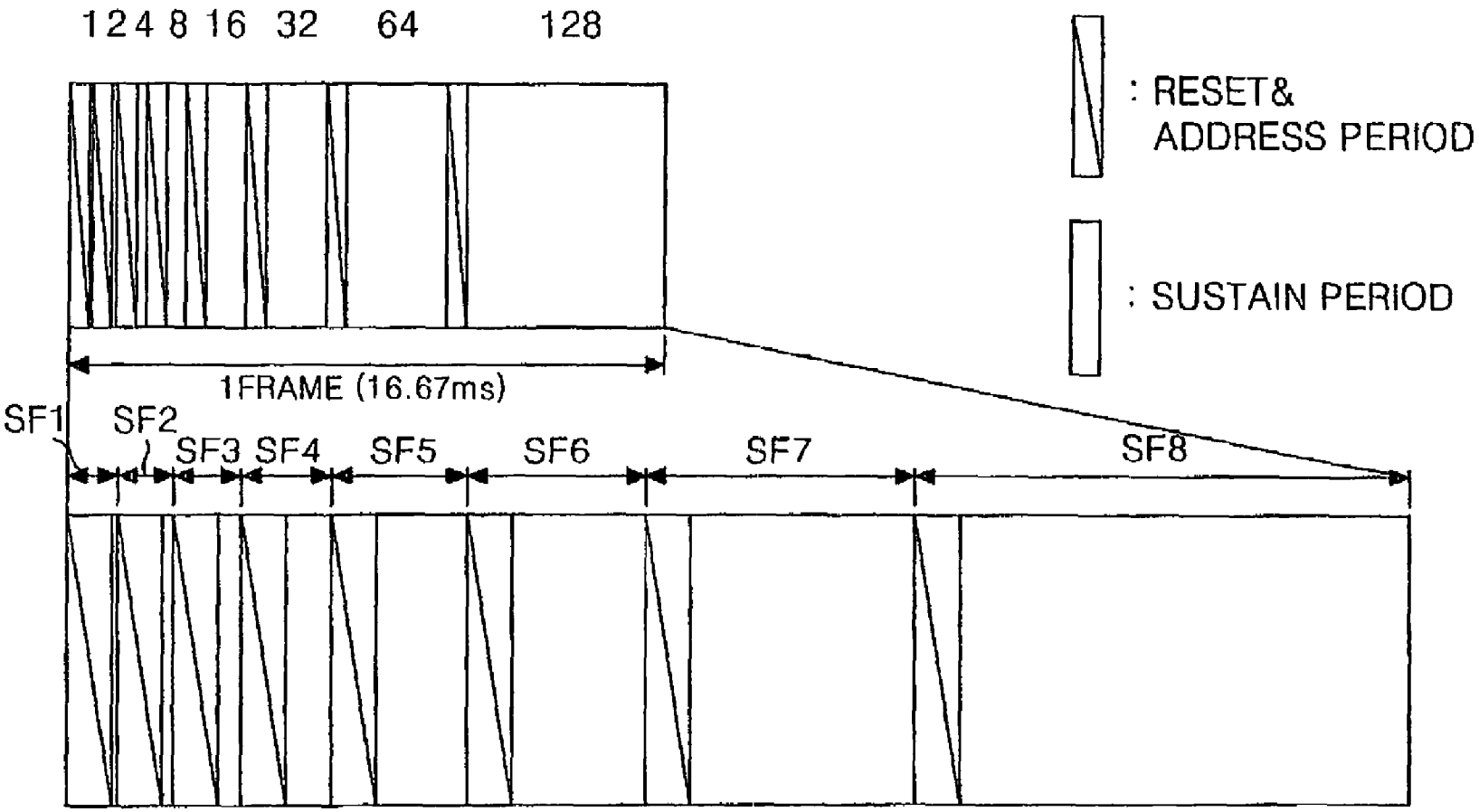
FIG.2 RELATED ART
FIG. 2 is diagram representing the subfield pattern of an 8-bit default code that implements 256 gray levels.
Figure 3:
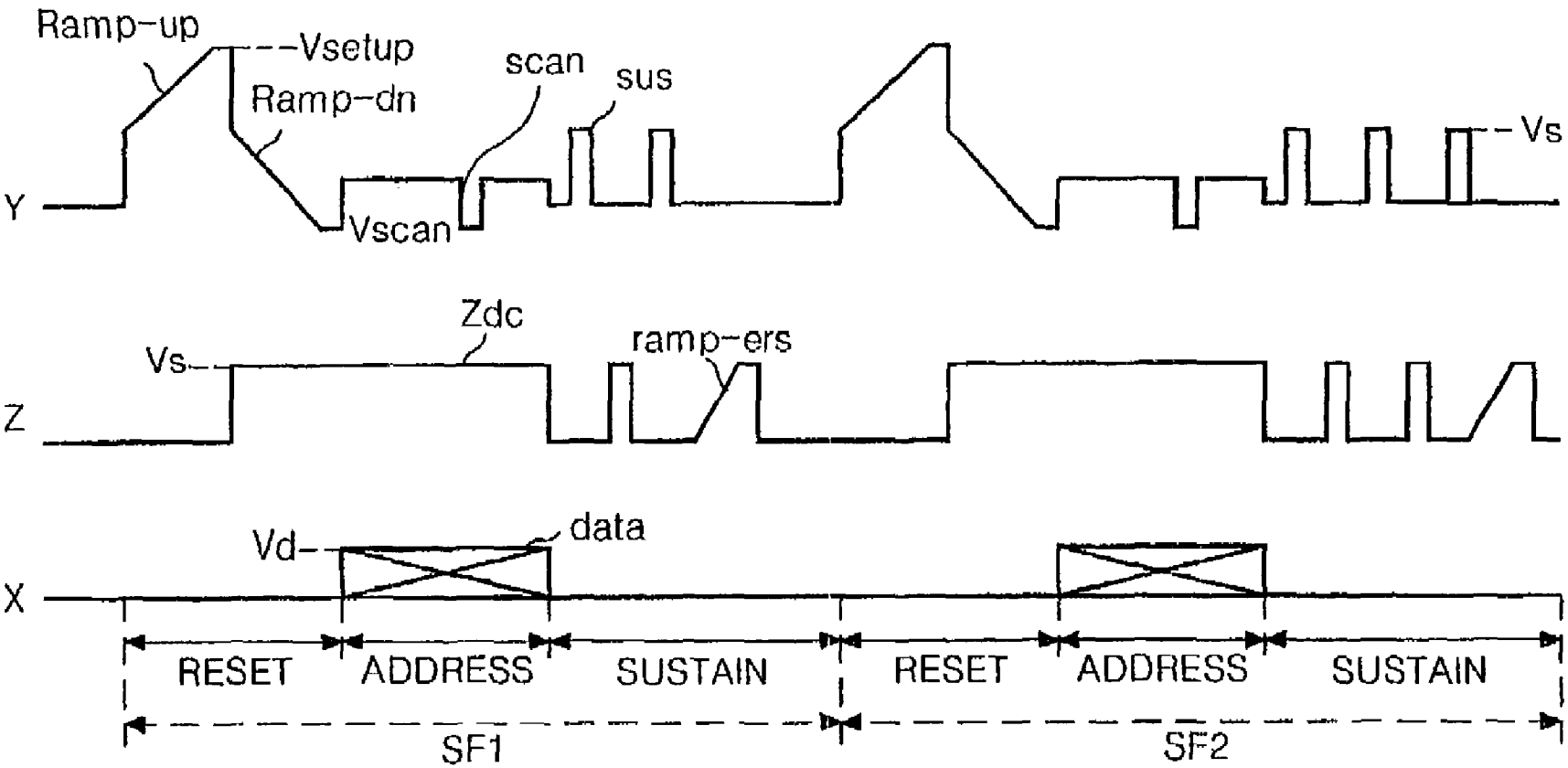
FIG.3 RELATED ART
FIG. 3 is a waveform diagram representing the driving waveform of a general plasma display panel.
Figure 4:
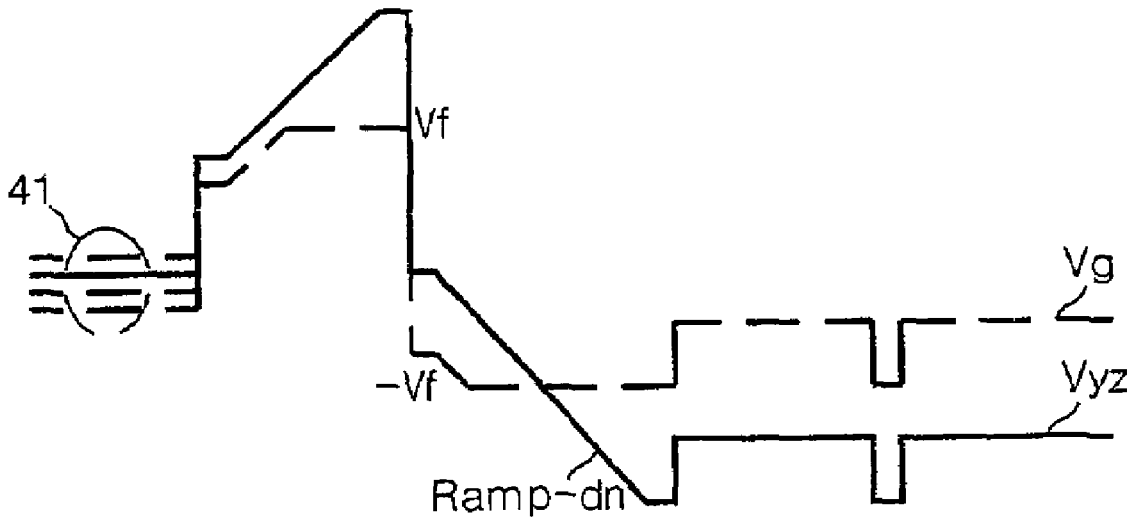
FIG. 4 RELATED ART
FIG. 4 is a waveform diagram representing the change of an external applied voltage and a gap voltage in a plasma display panel that has low Xe content.
Figure 5:
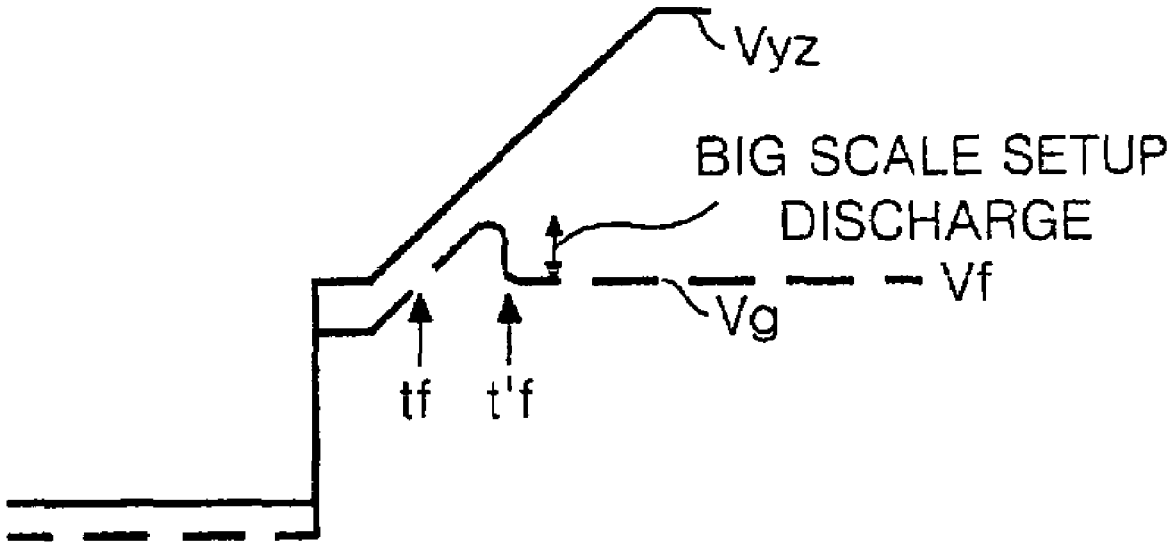
FIG. 5 RELATED ART
FIG. 5 is a waveform diagram representing the change of an external applied voltage and a gap voltage in a plasma display panel that has high Xe content.

In the initial setup period SU of the reset period, a rising ramp waveform Ramp-up that rises to a setup voltage Vsetup is applied to all the scan electrodes Y. Simultaneously, 0V or ground voltage GND is applied to the sustain electrodes Z and a high frequency pulse Prf1 of around data voltage Vd is applied to the address electrodes X. The high frequency pulse Prf1 might be generated only at the initial setup period SU or generated for the whole setup period SU. The rising ramp wave form Ramp-up causes a setup discharge where almost no light is generated between the scan electrode Y and the address electrode X and between the scan electrode Y and the sustain electrode Z within the cells of the full screen. The setup discharge causes positive (+) wall charges to be accumulated on the address electrode X and the sustain electrode Z, and negative (−) wall charges to be accumulated on the scan electrode Y. The high frequency pulse Prf1 applied to the address electrodes X applies impact to the discharge gas to prevent the setup discharge from being delayed as shown in FIG. 5, thereby causing the setup discharge to be generated at the firing voltage Vf.

In the latter set-down period SD of the reset period, a falling ramp waveform Ramp-dn that falls from around a sustain voltage Vs to a scan voltage Vs is applied to the scan electrodes Y. Simultaneously, the sustain voltage Vs as a DC bias voltage Vz-com is applied to the sustain electrodes Z and a high frequency pulse Prf2 of around data voltage Vd is applied to the address electrodes X. The high frequency pulse Prf2 might be generated only at the initial set-down period SD or generated for the whole set-down period SD. When the falling ramp waveform Ramp-dn is applied in this way, a set-down discharge is generated between the scan electrode Y and the sustain electrode Z, wherein almost no light is generated in the set-down discharge. The set-down discharge eliminates excessive wall charges that are unnecessary for the address discharge. After the set-down discharge is generated, positive wall charges remain on the address electrodes X and negative wall charges remain on the scan electrodes Y and the sustain electrodes Z. The high frequency pulse Prf2 applied to the address electrodes X applies impact to the discharge gas to prevent the set-down discharge from being delayed, thereby causing the setup discharge to be generated at the firing voltage Vf.

In the address period, scan pulses SCAN of negative scan voltage Vscan are sequentially applied to the scan electrodes Y and at the same time data pulses DATA of positive data voltage Vd synchronized with the scan pulses SCAN are applied to the address electrodes X. During the address period, a DC bias voltage Vz-com of sustain voltage Vs is applied to the sustain electrodes Z. As the voltage difference between the scan pulse SCAN and the data pulse DATA is added to the wall voltages caused by the wall charges remaining right after the reset period, the address discharge is generated within the cell to which the data pulse DATA is applied. When sustain voltages are applied, wall charges to the extent that the discharge might be generated are left within the cells selected by the address discharge.

In the sustain period, sustain pulses SUS are alternately applied to the scan electrodes Y and the sustain electrodes Z. Then, in the cells selected by the address discharge, as the wall voltage within the cell is added to the sustain pulse SUS, a sustain discharge, i.e., display discharge, is generated between the scan electrode Y and the sustain electrode Z whenever each sustain pulse SUS is applied. After completing the sustain discharge, an erasure ramp waveform ERS is applied to the sustain electrodes Z. The erasure ramp waveform ERS causes the erasure discharge within the cell to eliminate the wall charges, which remain within the cell, before the reset period.

Figure 8:
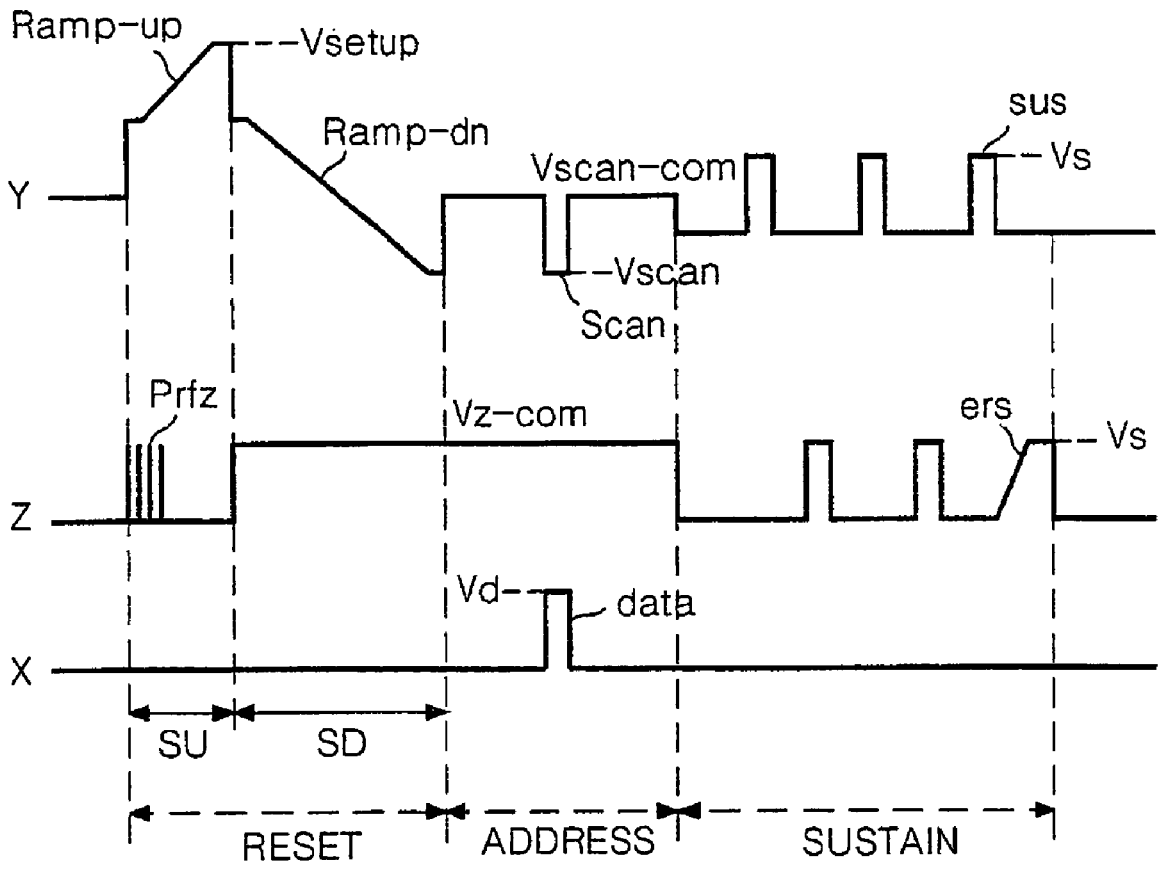
FIG. 8 is a waveform diagram to explain a driving method of a plasma display panel according to a second embodiment of the present invention.

FIG. 8 represents the driving waveform of a PDP according to a second embodiment of the present invention.

Referring to FIG. 8, a driving method of a PDP according to a second embodiment of the present invention applies a pulse waveform Prfz of high frequency to the sustain electrodes Z for the reset period.

In the initial setup period SU of the reset period, a rising ramp waveform Ramp-up that rises to a setup voltage Vsetup is applied to all the scan electrodes Y. Simultaneously, a high frequency pulse waveform Prfz is applied to the sustain electrodes Z and 0V or ground voltage GND is applied to the address electrodes X. The high frequency pulse waveform Prfz might be generated only at the initial setup period SU or generated for the whole setup period SU. The rising ramp wave form Ramp-up causes a set up discharge where almost no light is generated between the scan electrode Y and the address electrode X and between the scan electrode Y and the sustain electrode Z within the cells of the full screen. The setup discharge causes positive (+) wall charges to be accumulated on the address electrode X and the sustain electrode Z, and negative (−) wall charges to be accumulated on the scan electrode Y. The high frequency pulse waveform Prfz applied to the sustain electrodes Z applies impact to the discharge gas to prevent the setup discharge from being delayed as shown in FIG. 5, thereby causing the setup discharge to be generated at the firing voltage Vf.

In the latter set-down period SD of the reset period, a falling ramp waveform Ramp-dn that falls from around a sustain voltage Vs to a scan voltage Vs is applied to the scan electrodes Y. Simultaneously, the sustain voltage Vs as a DC bias voltage Vz-com is applied to the sustain electrodes Z and 0V or the ground voltage GND is applied to the address electrodes X. When the falling ramp waveform Ramp-dn is applied, a set-down discharge is generated between the scan electrode Y and the sustain electrode Z, wherein almost no light is generated in the set-down discharge. The set-down discharge eliminates excessive wall charges that are unnecessary for the address discharge. After the set-down discharge is generated, positive wall charges remain on the address electrodes X and negative wall charges remain on the scan electrodes Y and the sustain electrodes Z. Positive or negative high frequency pulses (not shown) are supplied to the sustain electrodes Z for the set-down period. The high frequency pulse reduces the delay of the set-down discharge, thereby causing the set-down discharge to be generated at the firing voltage Vf.

Because virtually the same waveforms as the driving waveform shown in FIG. 7 are generated in the address period and the sustain period, the detail description thereto is to be omitted.

Figure 9:
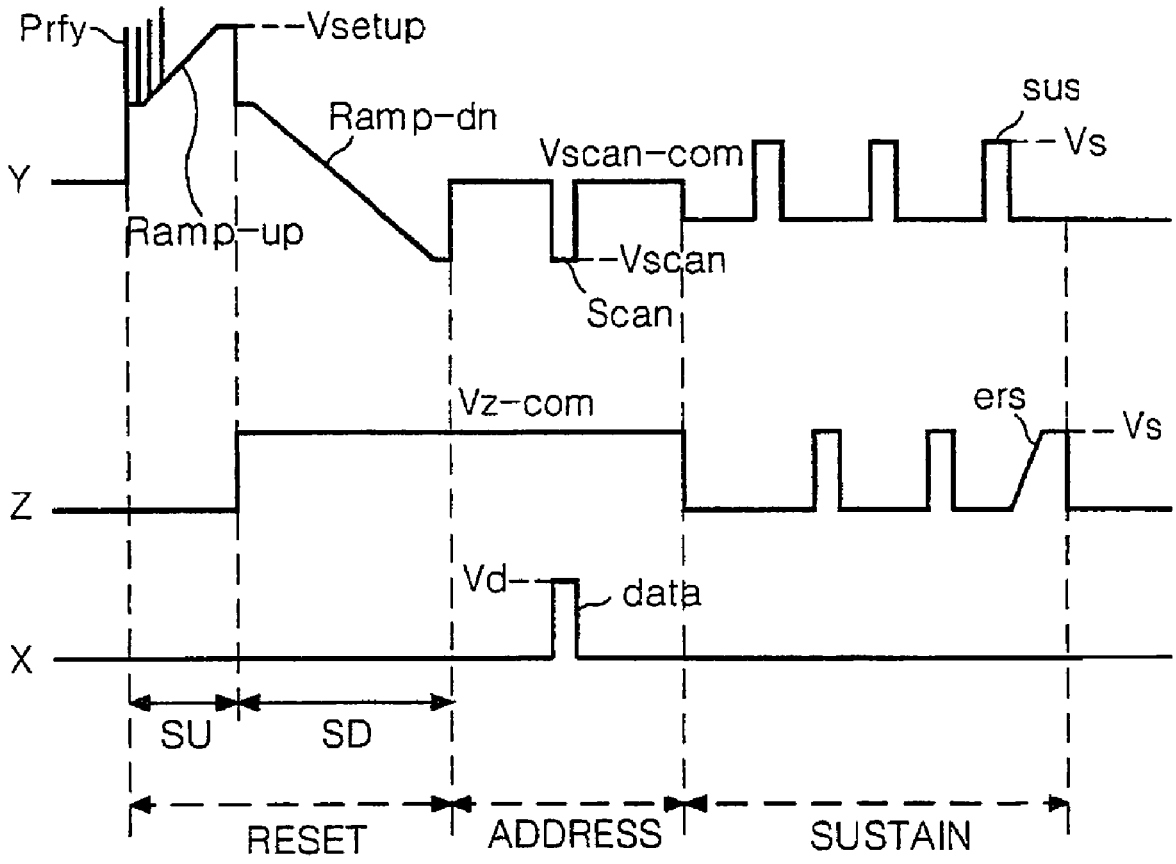
FIG. 9 is a waveform diagram to explain a driving method of a plasma display panel according to a third embodiment of the present invention.

FIG. 9 represents the driving waveform of a PDP according to a third embodiment of the present invention.

Referring to FIG. 9, a driving method of a PDP according to a third embodiment of the present invention applies a pulse waveform Prfz of high frequency to the scan electrodes Y for the reset period.

In the initial setup period SU of the reset period, a rising ramp waveform Ramp-up that rises to a setup voltage Vsetup is applied to all the scan electrodes Y, and at the same time a high frequency pulse a waveform Prfy is applied to the scan electrodes Y. Simultaneously, 0V or ground voltage GND is applied to the sustain electrodes Z and the address electrodes X. The high frequency pulse Prfy might be generated only at the initial setup period SU or generated for the whole setup period SU. The rising ramp waveform Ramp-up causes a setup discharge where almost no light is generated between the scan electrode Y and the address electrode X and between the scan electrode Y and the sustain electrode Z within the cells of the full screen. The setup discharge causes positive (+) wall charges to be accumulated on the address electrode X and the sustain electrode Z, and negative (−) wall charges to be accumulated on the scan electrode Y. The high frequency pulse Prfy applied to the scan electrodes Z applies impact to the discharge gas to prevent the setup discharge from being delayed as shown in FIG. 5, thereby causing the setup discharge to be generated at the firing voltage Vf.

In the latter set-down period SD of the reset period, a falling ramp waveform Ramp-dn that falls from around a sustain voltage Vs to a scan voltage Vs is applied to the scan electrodes Y. Simultaneously, the sustain voltage Vs as a DC bias voltage Vz-com is applied to the sustain electrodes Z and 0V or the ground voltage GND is applied to the address electrodes X. When the falling ramp waveform Ramp-dn is applied, a set-down discharge is generated between the scan electrode Y and the sustain electrode Z, wherein almost no light is generated in the set-down discharge. The set-down discharge eliminates excessive wall charges that are unnecessary for the address discharge. After the set-down discharge is generated, positive wall charges remain on the address electrodes X and negative wall charges remain on the scan electrodes Y and the sustain electrodes Z. Positive or negative high frequency pulses (not shown) are supplied to the sustain electrodes Z for the set-down period. The high frequency pulse reduces the delay of the set-down discharge, thereby causing the set-down discharge to be generated at the firing voltage Vf.

Because virtually the same waveforms as the driving waveform shown in FIG. 7 are generated in the address period and the sustain period, the detail description thereto is to be omitted.

On the other hand, the foregoing embodiments were explained by putting focus on an example that a ramp waveform is applied only to the scan electrode Y for the reset period, but the ramp waveform might be applied to the sustain electrode Z.

As a result, the driving method and apparatus of the PDP according to the embodiment of the present invention prevents the setup discharge or the set-down discharge from being delayed even if the high frequency pulse is applied to any one of the address electrodes X, the sustain electrodes Z and the sustain electrodes Y, to have the content of Xe increased in the discharge gas.

As described above, the driving method and apparatus of the PDP according to the present invention applies the high frequency pulse to the electrode of the PDP for at least part of the reset period, thereby reducing the discharge delay of the setup discharge or the set-down discharge. As a result, the driving method and apparatus of the PDP according to the present invention causes the setup discharge or the set-down discharge to be in more stable dark discharge state to minimize the light that is generated in a non-display period, thereby improving the contrast characteristic to increase the resolution of the display picture.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. A driving method of a plasma display panel having address electrodes, a scan electrode and a sustain electrode, wherein one frame is divided into a reset period, an address period and a sustain period, the method comprising:

applying a rising waveform to the scan electrode during the reset period, the rising waveform starting from a first voltage greater than a ground voltage; and applying at least one first pulse to the address electrodes of the plasma display panel during the reset period, wherein the at least one first pulse applied to the address electrodes is applied during a setup time of the reset period.

2. The driving method according to claim 1, wherein the at least one first pulse is of positive voltage.

3. The driving method according to claim 1, wherein the at least one first pulse is of negative voltage.

4. The driving method according to claim 1, further comprising:

initializing a cell by consecutively applying the rising ramp waveform and a falling ramp waveform to the scan electrode during the reset period to cause a write setup discharge and an erasure set-down discharge to be generated;

selecting the cell by simultaneously applying a scan pulse to the scan electrode and data to the data electrode during the address period; and performing display on the cell by alternately applying a sustain pulse to the scan electrode and the sustain electrode during the sustain period.

5. The driving method according to claim 1, further comprising:

eliminating wall charges within the cell by applying an erasure signal to at least one of the scan electrode and the sustain electrode between the sustain period and the reset period.

6. A driving method of a plasma display panel having an address electrode, a scan electrode and a sustain electrode with a cell disposed at each intersection of the electrodes, wherein one frame is divided into a reset period, an address period and a sustain period, the method comprising:

applying a plurality of first pulses to the address electrode during a setup time of the reset period, wherein the first pulses are pulse signals of a high frequency band;

applying a plurality of second pulses to the address electrode during a set-down time of the reset period, the set-down time beginning after the setup time; and applying a gradually-increasing voltage to at least one of the scan electrode and the sustain electrode to generate a discharge during the reset period.

7. The driving method according to claim 6, wherein the first pulses are of positive voltage.

8. The driving method according to claim 6, wherein the first pulses are of negative voltage.

9. The driving method according to claim 6, wherein applying a gradually-increasing voltage to at least one of the scan electrode and the sustain electrode to generate a discharge within the cell includes:

consecutively applying a rising ramp waveform and a falling ramp waveform to the scan electrode during the reset period to generate a write setup discharge and an erasure set-down discharge.

10. The driving method according to claim 6, further comprising:

selecting the cell by simultaneously applying a scan pulse to the scan electrode and data to the data electrode during the address period; and performing display on the cell by alternately applying a sustain pulse to the scan electrode and the sustain electrode during the sustain period.

11. The driving method according to claim 10, further comprising:

eliminating wall charges within the cell by applying an erasure signal to at least one of the scan electrode and the sustain electrode between the sustain period and the reset period.

12. A driving apparatus of a plasma display panel having an address electrode, a scan electrode and a sustain electrode, wherein one frame is divided into a reset period, an address period and a sustain period, the apparatus comprising:

an address driver to apply a pulse to the address electrode of the plasma display panel during a setup time of the reset period.

13. The driving apparatus according to claim 12, wherein the address driver generates the pulse of positive voltage.

14. The driving apparatus according to claim 12, wherein the address driver generates the pulse of negative voltage.

15. A driving apparatus of a plasma display panel having address electrodes, a scan electrode and a sustain electrode with a cell disposed at each intersection of the electrodes, wherein one frame is divided into a reset period, an address period and a sustain period, the apparatus comprising:

a first initialization driver to apply a first pulse to at least one of the address electrodes during a setup time of the reset period; and a second initialization driver to apply a gradually-increasing voltage to at least one of the scan electrode and the sustain electrode to generate a discharge within the cell during the reset period.

16. The driving apparatus according to claim 15, wherein the first initialization driver applies a plurality of first pulses to the address electrodes during the reset period.

17. The driving apparatus according to claim 16, wherein the plurality of first pulses comprise high frequency pulses.

18. The driving apparatus according to claim 15, wherein the first initialization driver applies at least one second pulse to one of the address electrodes during the reset period.

19. The driving apparatus according to claim 15, wherein the first initialization driver applies a plurality of second pulses to one of the address electrodes during the reset period.

20. The driving apparatus according to claim 15, wherein the second initialization driver applies the gradually increasing voltage to the at least one of the scan electrode and the sustain electrode during the setup time.

21. A driving apparatus of a plasma display panel having address electrodes, a scan electrode and a sustain electrode with a cell disposed at each intersection of the electrodes, wherein one frame is divided into a reset period, an address period and a sustain period, the apparatus comprising:

a first initialization driver to apply a first pulse to at least one of the address electrodes during the reset period; and a second initialization driver to apply a gradually-increasing voltage to at least one of the scan electrode and the sustain electrode to generate a discharge within the cell during the reset period, wherein the first pulse applied to the at least one of the address electrodes is applied during a set-down time of the rest period.

22. The driving apparatus according to claim 21, wherein the second initialization driver applies a gradually-decreasing voltage to the at least one of the scan electrode and the sustain electrode during the setdown time of the reset period.

23. The driving method according to claim 1, further comprising applying a plurality of first pulses to the address electrodes during the reset period.

24. The driving method according to claim 23, wherein the plurality of first pulses comprise high frequency pulses.

25. The driving method according to claim 1, further comprising applying at least one second pulse to the address electrodes during the reset period.

26. The driving method according to claim 1, further comprising applying a plurality of second pulses to the address electrode during the reset period.

27. The driving method according to claim 1, wherein the rising waveform is applied to the scan electrode during the setup time of the reset period.

28. The driving method according to claim 1, further comprising applying another first pulse to the address electrode during a set-down time of the reset period.

29. The driving method according to claim 28, further comprising applying a falling waveform to the scan electrode during the set-down time of the reset period.

30. The driving method according to claim 4, wherein a voltage of the at least one first pulse corresponds to a voltage of the data applied to the data electrode.

31. The driving method according to claim 4, wherein a voltage of the at least one first pulse corresponds to a voltage of the sustain pulse applied to the sustain electrode.

32. The driving method according to claim 6, wherein the gradually-increasing voltage is applied to the scan electrode during the setup time of the reset period.

33. The driving apparatus according to claim 6, wherein initializing the cell includes applying a gradually-decreasing voltage to the at least one of the scan electrode and the sustain electrode during the set-down time of the reset period.

34. The driving apparatus according to claim 12, wherein the address driver applies a plurality of pulses to the address electrode during the reset period.

35. The driving apparatus according to claim 34, wherein the plurality of pulses comprise high frequency pulses.

36. The driving apparatus according to claim 12, wherein the address driver applies at least another pulse to the address electrode during the reset period.

37. The driving apparatus according to claim 12, further comprising another driver to apply a rising waveform to the scan electrode or the sustain electrode during the setup time, the rising waveform increasing from a first voltage greater than a ground voltage.

38. A driving apparatus of a plasma display panel having an address electrode, a scan electrode and a sustain electrode, wherein one frame is divided into a reset period, an address period and a sustain period, the apparatus comprising:

an address driver to apply a pulse to the address electrode of the plasma display panel during a set-down time of the reset period.

39. The driving apparatus according to claim 38, further comprising another driver to apply a falling waveform to the scan electrode or the sustain electrode during a set-down time of the reset period.

40. The driving method according to claim 1, further comprising:

applying a falling waveform to the scan voltage during the reset period, the falling waveform decreasing to a second voltage.

41. The driving method according to claim 40, further comprising:

applying a scan pulse to the scan electrode during the address period, the scan pulse increasing from the second voltage to a third voltage and decreasing to the second voltage.

42. The driving method according to claim 41, wherein the third voltage is greater than a ground voltage and less than the first voltage.

43. The driving method according to claim 1, further comprising:

applying a DC bias voltage to the sustain electrode during part of the reset period and during the address period; and applying a sustain pulse to the sustain electrode during the sustain period, the sustain pulse being a same voltage as the DC bias voltage.

44. The driving method according to claim 1, further comprising:

applying a data pulse to the address electrode during the address period, and wherein a voltage of the at least one first pulse equals a voltage of the data pulse.

45. The driving method according to claim 6, wherein the gradually-increasing voltage is applied to the scan electrode starting from a first voltage greater than a ground voltage, and the method further comprising:

applying a gradually-decreasing voltage to the scan voltage during the reset period, the gradually-decreasing voltage decreasing to a second voltage.

46. The driving method according to claim 45, further comprising:

applying a scan pulse to the scan electrode during the address period, the scan pulse increasing from the second voltage to a third voltage and decreasing to the second voltage.

47. The driving method according to claim 46, wherein the third voltage is greater than a ground voltage and less than the first voltage.

48. The driving method according to claim 6, further comprising:

applying a DC bias voltage to the sustain electrode during part of the reset period and during the address period; and applying a sustain pulse to the sustain electrode during the sustain period, the sustain pulse being a same voltage as the DC bias voltage.

49. The driving method according to claim 6, further comprising:

applying a data pulse to the address electrode during the address period, and wherein a voltage of the first pulses equals a voltage of the data pulse.

50. The driving apparatus according to claim 37, wherein the another driver to apply a falling waveform to the scan voltage during the reset period, the falling waveform decreasing to a second voltage.

51. The driving apparatus according to claim 50, further comprising:

a scan driver to apply a scan pulse to the scan electrode during the address pulse, the scan pulse increasing from the second voltage to a third voltage and decreasing to the second voltage.

52. The driving apparatus according to claim 51, wherein the third voltage is greater than a ground voltage.

53. The driving apparatus according to claim 12, further comprising:

a sustain driver to apply a DC bias voltage to the sustain electrode during part of the reset period and during the address period and to apply a sustain pulse to the sustain electrode during the sustain period, the sustain pulse being a same voltage as the DC bias voltage.

54. The driving apparatus according to claim 12, wherein the address driver to apply a data pulse to the address electrode during the address period, and wherein a voltage of the pulse equals a voltage of the data pulse.

55. The driving apparatus according to claim 15, wherein the second initialization driver applies the gradually-increasing voltage from a first voltage greater than a ground voltage, and the second initialization driver to apply a gradually-decreasing voltage to the scan voltage during the reset period, the gradually-decreasing voltage decreasing to a second voltage.

56. The driving apparatus according to claim 55, further comprising:

a scan driver to apply a scan pulse to the scan electrode during the address period, the scan pulse increasing from the second voltage to a third voltage and decreasing to the second voltage, wherein the third voltage is greater than a ground voltage and less than the first voltage.

57. The driving apparatus according to claim 21, wherein the second initialization driver applies the gradually-increasing voltage from a first voltage greater than a ground voltage, and the second initialization driver to apply a gradually-decreasing voltage to the scan electrode during the reset period, the gradually-decreasing voltage decreasing to a second voltage.

58. The driving apparatus according to claim 57, wherein the second initialization driver comprises a scan driver to apply a scan pulse to the scan electrode during the address period, the scan pulse increasing from the second voltage to a third voltage and decreasing to the second pulse, wherein the third voltage is greater than a ground voltage and less than the first voltage.

59. The driving apparatus according to claim 38, further comprising:

another driver to apply a rising waveform to the scan electrode or the sustain electrode during a setup time of the reset period, the rising waveform increasing from a first voltage greater than a ground voltage.

60. The driving apparatus according to claim 59, wherein the another driver to apply a falling waveform to the scan voltage during the reset period, the falling waveform decreasing to a second voltage.

61. The driving apparatus according to claim 60, wherein the another driver to apply a scan pulse to the scan electrode during the address period, the scan pulse increasing from the second voltage to a third voltage and decreasing to the second voltage, wherein the third voltage is greater than a ground voltage and less than the first voltage.

* * * * *